United States Patent [19]

Sugimoto

[11] 3,973,822

[45] Aug. 10, 1976

[54] TERMINAL APPARATUS

[75] Inventor: Yasuo Sugimoto, Musashino, Japan

[73] Assignee: Sony Corporation, Tokyo, Japan

[22] Filed: Dec. 3, 1974

[21] Appl. No.: 529,088

[30] Foreign Application Priority Data

Dec. 5, 1973 Japan ..... 48-140685

[52] U.S. Cl. ..... 339/274

[51] Int. Cl.[2] ..... H01R 9/12

[58] Field of Search..... 339/95, 97, 266, 269–271, 339/274

[56] References Cited

UNITED STATES PATENTS

| | | | |
|---|---|---|---|
| 2,553,341 | 5/1951 | Stonehill | 339/274 |
| 2,556,491 | 6/1951 | De Lorenzo | 339/274 |
| 3,675,182 | 7/1972 | Gregory | 339/274 |

*Primary Examiner*—Joseph H. McGlynn
*Attorney, Agent, or Firm*—Hill, Gross, Simpson, Van Santen, Steadman, Chiara & Simpson

[57] ABSTRACT

A terminal apparatus used for connecting a lead wire to a terminal, includes a cylindrical rotor having an operating knob and a hole for inserting the lead wire therethrough, and a terminal plate having spring effect. The lead wire inserted through the hole is fixed or released between the surface of the cylindrical rotor and the terminal plate in response to the rotation of the cylindrical rotor. In the fixed position, the lead wire is prevented from disengaging in the presence of an outward drawing force by the spring effect of the terminal plate together with corners of the rotor hole.

4 Claims, 6 Drawing Figures

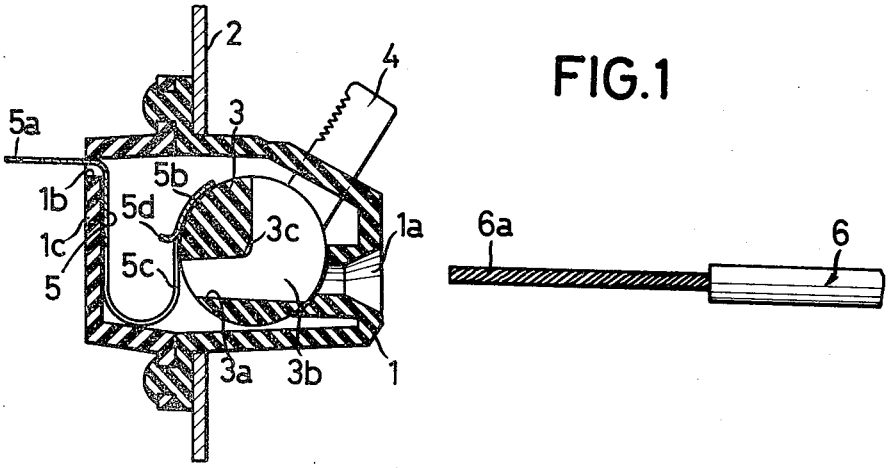
FIG.1
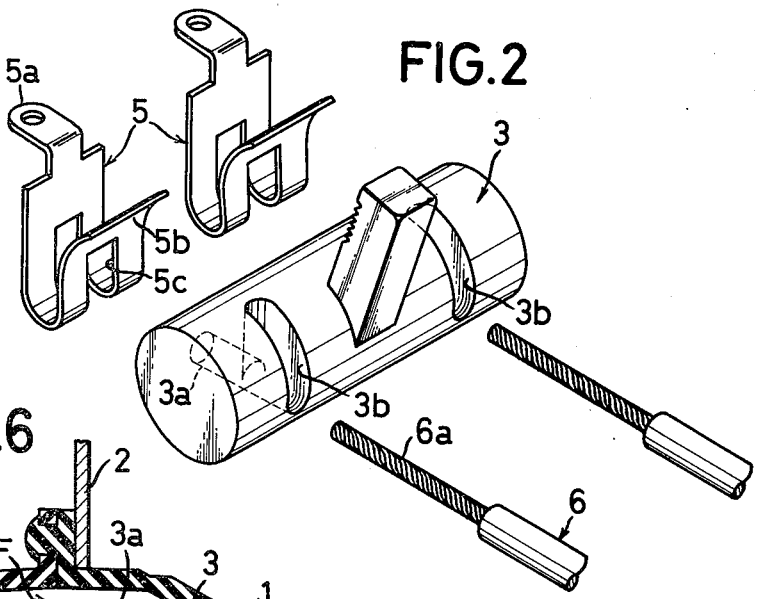
FIG.2
FIG.6
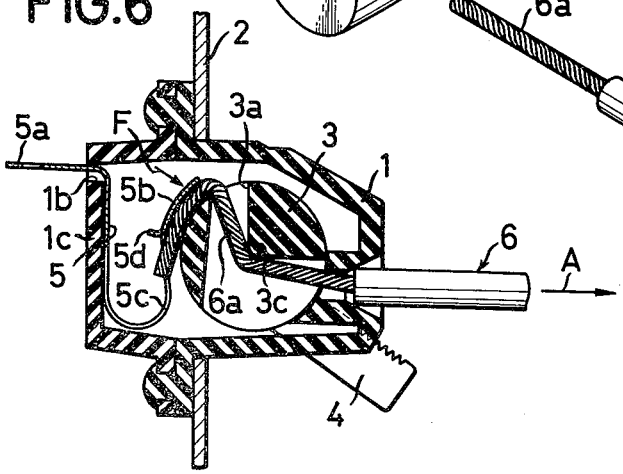

TERMINAL APPARATUS

BACKGROUND OF THE INVENTION

1. Field of the Invention

This invention relates to a terminal apparatus and in particular to a terminal apparatus for receiving and retaining a straight lead wire.

2. Description of the Prior Art:

Hitherto, a terminal apparatus of the push-button type or the piano-key type is used for connecting a lead wire of a loudspeaker to an output terminal of a stereo-amplifier. Since a conductor of the lead wire is exposed to an operator's hand in the terminal apparatus of the push-button type, there is the danger that the operator may be shocked. The apparatus of the piano-key type is complicated in construction. Therefore, it has the disadvantage that long construction time and expensive production equipment is necessary.

SUMMARY OF THE INVENTION

An object of this invention is to provide a novel terminal apparatus which can eliminate the above-mentioned disadvantages of the conventional terminal apparatus.

Another object of this invention is to provide a terminal apparatus which is simple in construction and in which there is no danger that the operator is struck by electricity.

It is a further object of the invention to provide a terminal apparatus in which a user does not need tools such as a screwdriver and connections are simple and rapid.

It is a further object of this invention to provide a terminal apparatus in which the surface contact between the lead wire and terminal is large to insure good electrical contact.

A still further object of this invention is to provide a terminal apparatus which includes a cylindrical rotor and a substantially U-shaped terminal plate in a case, the terminal plate is pressed against the surface of the cylindrical rotor, a hole is made in the cylindrical rotor for inserting a lead wire therethrough, and a tip portion of the lead wire projected from the hole is bent with the rotation of the cylindrical rotor so as to be pressed between the terminal plate and the surface of the cylindrical rotor, and thereby the lead wire can be securely fixed in simple operation.

The above, and other objects, features and advantages of the invention, will be apparent in the following detailed description of illustrative embodiments thereof which is to be read in connection with the accompanying drawings.

BRIEF DESCRIPTION OF THE DRAWINGS

FIG. 1 is a cross-sectional view of a terminal apparatus according to one embodiment of this invention;

FIG. 2 is a perspective view of important parts of the terminal apparatus of FIG. 1;

FIG. 4 to FIG. 6 are cross-sectional views of the terminal apparatus for explaining operation thereof, respectively.

DESCRIPTION OF THE PREFERRED EMBODIMENTS

Figure 3:
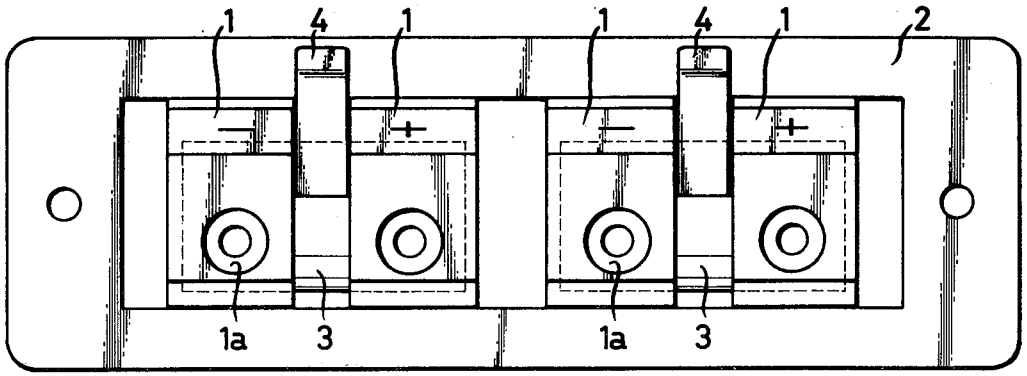
FIG. 3 is a front view of a terminal apparatus for a two-channel stereo-amplifier, according to another embodiment of this invention.

A preferred embodiment of this invention will be described with reference to FIG. 1 and FIG. 2.

In FIG. 2, a terminal apparatus for two lead wires is shown, but it will be hereafter described with respect to one lead wire. The description with respect to the one lead wire is substantially equal to that with respect to the other lead wire, the only difference being, for example, that the one lead wire is connected to a positive terminal and the other lead wire is connected to a negative terminal.

A front opening 1*a* for inserting a lead wire 6 is made in a front wall of a case 1. A rear opening 1*b* for a terminal plate is made in a rear wall 1*c* of the case 1. The case 1 is mounted on a mounting plate 2 which is fixed to a chassis, not shown. FIG. 2 shows a perspective view of important parts arranged in the case 1. A rotor 3 is substantially cylindrical, and it is rotatably supported in the case 1. A hole 3*a* for inserting the lead wire 6 therethrough is made in the rotor 3. The hole 3*a* communicates with the front opening 1*a*. A substantially quadrantal slot 3*b* is formed adjacent to the hole 3*a* in the rotor 3. When the rotor 3 is rotated in the direction shown by the arrow on FIG. 4 or FIG. 5, one portion of a conductor 6*a* of the lead wire 6 is positioned into the substantially quadrantal slot 3*b*, as shown on FIG. 6. An opening knob 4 is fixed on the rotor 3. The knob 4 is projected from the case 1. A substantially U-shaped terminal plate 5 is formed of electrically conductive material such as phosphor bronze, having a spring effect. The terminal plate 5 is fixed on the rear wall 1*c* of the case 1. A terminal 5*a* is formed on one end of the terminal plate 5, as one body. The terminal 5*a* is projected from the rear opening 1*b* of the case 1, which is connected to an output terminal of an amplifier within a chassis (not shown). Another end 5*b* of the terminal plate 5 presses against the surface of the rotor 3 by its own spring effect. A cut-out portion 5*c* is formed in the terminal plate 5. The exposed conductor 6*a* of the lead wire 6 is inserted through the hole 3*a* of the rotor 3 and the cut-out portion 5*c* of the terminal plate 5 to reach the rear wall 1*c* of the case 1. A bent portion 5*d* is formed on one edge of the cut-out portion 5*c* of the terminal plate 5 to guide the tip portion of the conductor 6*a* of the lead wire 6.

Next, operations of the terminal apparatus will be described with reference to FIG. 4 through FIG. 6.

An insulator of the lead wire 6 is stripped off by a suitable length to expose the conductor 6*a*. The conductor 6*a* of the lead wire 6 is inserted through the front opening 1*a*, the hole 3*a* of the rotor 3 and the cut-out portion 5*c* of the terminal plate 5 until it approaches or contacts the rear wall 1*c* of the case 1 (FIG. 4).

Figure 4:
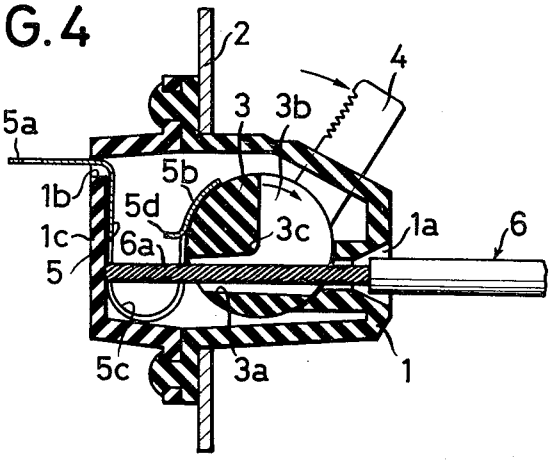
Figure 5:
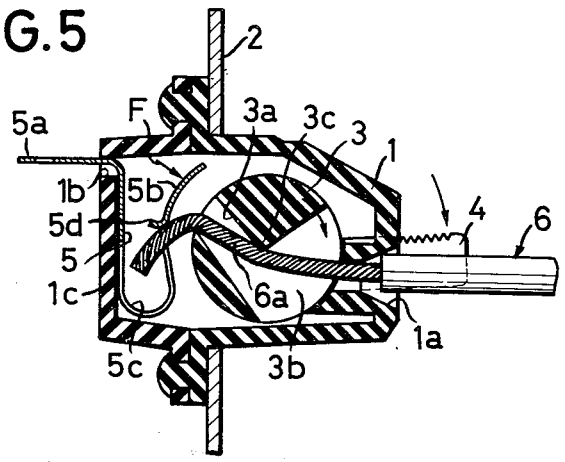

When the rotor 3 is rotated in the direction shown by the arrow on FIG. 4, with the operating knob 4, the tip portion of the conductor 6*a* is bent by corners of the hole 3*a*, and the one end 5*b* of the terminal plate 5 is pushed away by the tip portion of the conductor 6*a* (FIG. 5). When the rotor 3 is further rotated in the direction shown by the arrow on FIG. 5 with the operating knob 4, the tip portion of the conductor 6*a* is further bent by the corners of the hole 3*a*, and it is put between the one end 5*b* of the terminal plate 5 and the surface of the rotor 3 under the influence of a spring effect F of the terminal plate 5 (FIG. 6).

The tip portion of the conductor 6*a* is elastically locked between the one end 5*b* of the terminal plate 5 and the surface of the rotor 3 with about a 90° rotation of the operating knob 4. Thus, the lead wire 6 is in a large and low resistance electrical contact with the terminal plate 5. When a drawing force is applied to the lead wire 6 in the direction shown by the arrow A on FIG. 6, the conductor 6*a* is stopped by a corner 3*c* of the hole 3*a* and the slot 3*b*. The lead wire 6 is prevented from being released from the terminal apparatus by the stop action of the corner 3*c* and the spring effect F of the one end 5*b* of the terminl plate 5.

FIG. 3 shows another embodiment and use of this invention. A terminal bank comprising a pair of the apparatuses shown on FIG. 1 or FIG. 2 is suitable for a two-channel stereo-amplifier. Parts in FIG. 3 which correspond to those in FIG. 2 are denoted by the same reference numerals, the description of which will be omitted.

According to this embodiment, as above mentioned, the cylindrical rotor and the substantially U-shape terminal plate having spring effect are arranged in the case. The hole is made in the rotor for inserting the exposed conductive portion of the lead wire. The end portion of the terminal plate presses against the surface of the rotor. With the rotation of the rotor, the tip portion of the exposed conductive portion of the lead wire projected from the hole of the rotor is bent, and pinched between the end portion of the terminal plate and the surface of the rotor. The rotor arms 4 may be ganged or independent.

In a variation of this embodiment, each entrance hole 1*a* may have its own rotor arm and rotor associated with it. Thus, the locking of each lead wire can be made independent of the other.

Therefore, according to this invention the lead wire can be securely connected to the terminal by the simple operation of inserting the conductive portion of the lead wire into the case and then rotating the rotor with the operating knob fixed on the rotor. The lead wire is prevented from being taken off of the terminal apparatus by the stop action of the corner of the hole and the spring effect of the terminal plate. Since the electrically conductive portion is not externally exposed, there is no danger that the operator's hand touches the electrically conductive portion. The terminal apparatus can be very safely used. Moreover, it is simple in construction, the construction time is reduced, and the user can make fast connections without the use of a screw driver or other tool.

It should be understood that although a two wire terminal apparatus is disclosed in the preferred embodiment, single or multiple terminal apparatuses designed for one or more lead wires are obvious alternative embodiments of this invention.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention, as defined in the appended claims.

I claim as my invention:

1. A terminal apparatus used for connecting a lead wire to a terminal plate provided in a case, said terminal apparatus comprising:

a. a cylindrical rotor supported rotatably in said case having an operating knob, a hole for inserting said lead wire therethrough, and a substantially quadrantal slot formed in said cylindrical rotor adjacent to said hole and the corner formed by said hole and slot being used for holding said lead wire when it is in a lock state; and b. a U-shaped terminal plate having a member of spring effect, said member being biased so as to contact with the surface of said rotor, the tip of said lead wire inserted through said hole being locked between said member and the surface of said rotor in response to its rotation.

2. A terminal apparatus used for connecting a lead wire to a terminal plate provided in a case, said terminal apparatus comprising:

a. a cylindrical rotor supported rotatably in said case having an operating knob effective to rotate said rotor approximately one quarter of a turn, a hole for inserting said lead wire therethrough, and a substantially quandrantal slot formed in said cylindrical rotor adjacent to said hole and the corner formed by said hole and slot being used for holding said lead wire when it is in a locked state; and b. a U-shaped terminal plate having a member of spring effect, said member being biased so as to contact with the surface of said rotor, the tip of said lead wire inserted through said hole being locked between said member and the surface of said rotor in response to its rotation.

3. A terminal apparatus used for connecting a lead wire to a terminal plate provided in a case, said terminal apparatus comprising:

a. a cylindrical rotor having an operating knob and an aperture for inserting said lead wire therethrough and providing a surface for bending a tip of said wire at an edge of said aperture, said rotor being supported rotatably in said case to permit rotation about a central axis of the rotor;

b. a terminal plate having a member of spring effect with an arcuate surface, said member being biased so as to contact with the surface of said rotor substantially along said arcuate surface, the tip of said lead wire inserted through said aperture being locked between said member and the surface of said rotor in response to its rotation; and c. a substantially quadrantal slot formed in said cylindrical rotor adjacent to said aperture, the corner formed by said aperture and slot being used for holding said lead wire when it is in a locked state.

4. A terminal apparatus according to claim 3 in which said rotor rotates substantially one quarter of a turn in response to said operating knob.

* * * * *